US006058509A

United States Patent [19]

Was

[11] Patent Number: 6,058,509

[45] Date of Patent: May 9, 2000

[54] FINGERLESS GARMENT

[76] Inventor: April J. P. Was, 36 Bardwell St., South Hadley, Mass. 01075

[21] Appl. No.: 09/236,795

[22] Filed: Jan. 25, 1999

[51] Int. Cl.[7] ..... A41D 25/00

[52] U.S. Cl. ..... 2/158; 15/227

[58] Field of Search ..... 2/16, 20, 158, 2/917; 15/227

[56] References Cited

U.S. PATENT DOCUMENTS

| | | | |
|---|---|---|---|
| D. 192,992 | 6/1962 | Ruiter | D3/11 |
| D. 377,053 | 12/1996 | Williams | D20/33 |
| D. 380,285 | 7/1997 | Babcock | D2/622 |
| D. 397,363 | 8/1998 | Williams | D20/33 |
| 2,505,409 | 4/1950 | Kirchner | 15/227 |
| 3,135,966 | 6/1964 | Higgins et al. | 2/158 |
| 5,572,744 | 11/1996 | Reid, Jr. et al. | 2/158 |

*Primary Examiner*—Diana Oleksa
*Assistant Examiner*—Katherine Moran
*Attorney, Agent, or Firm*—McCormick, Paulding & Huber LLP

[57] ABSTRACT

A fingerless garment is provided having a fan-shaped chamber and an elongated cuff fabricated out of stretchable and warm material that permits convenient hand use and ease of dressing for the very young or those with disabilities associated with the hand. The hand garment may be made of a non-raveling fleece fabric of the type described as Polarfleece® that is soft, quick drying, warm, and breathable.

7 Claims, 2 Drawing Sheets

FINGERLESS GARMENT

FIELD OF THE INVENTION

The present invention relates to fingerless garments worn on the hands and, more specifically, to fingerless garments that have a fan shape which allows the wearer to grasp objects conveniently using the thumb. It is particularly suitable for the very young and for those who have difficulty flexing and controlling the hand.

BACKGROUND OF THE INVENTION

Fingerless hand garments, for example the Baby Mitt described in U.S. Pat. No. 3,135,966, have been used to facilitate the dressing of an infant. The baby mitt of the '966 patent is made of one piece of thermoplastic material with welded gathers or pleats at the wrist to prevent self-removal of the mitt by the infant. The mitts are designed to prevent the infant from grabbing hold of the insides of sleeves while the infant is being dressed. The thermoplastic material is not directed to keeping the hand warm and is therefore not suitable for cold weather outdoor use.

Fingerless mittens have also been used as cleaning and polishing cloths, as in the Cleaning and Polishing Mitt described in U.S. Pat. No. 2,505,409. The '409 patent describes a multilayer mitt having two polishing surfaces and a cuff element formed of woven or other wrist engaging material. The outer layers of the mitt are loosely secured to the cuff so that they may be successively removed as the layers become soiled beyond further use. Loosely stitched polishing mitts are not directed to withstand the wear likely to result from active outdoor play.

A fingerless mitten having pouches for receiving packages of heat-transfer material and directed to providing relief to people afflicted with arthritis, poor circulation, and similar medical problems associated with age, is described in U.S. Pat. No. 5, 572,744, entitled: Mitten Suitable for Heat Transfer. The packages of heat-transfer material are inserted into the pouches and the mitten is placed in a microwave to heat the material, or in a freezer to cool the material. After sufficient heating or cooling, the mitten is placed on the user's had to provide hours of warmth or cold. With packages of heat-transfer material in the pouches, the '744 patent does not permit full or convenient hand use by the wearer.

Design patents for fingerless mittens have also been issued as shown in Pat. Nos. Des. 397,363 and Des. 377,053, both entitled: Display Garment for the Hand, and as in Des. 380,285 entitled: Fingerless Mitten. The display garments of the '363 and '053 Design patents are typically used at sporting events to signal support for a favorite team. The '285 patent is directed to a costume piece. None of the design patents is directed to a garment that permits convenient hand use.

The present invention is directed to overcoming drawbacks inherent in all fingerless garments, namely the ability to conveniently grasp objects in a normal fashion with opposing thumb, while at the same time providing a garment suited for young children, as well as for people of all ages who have motor control problems or other disabilities associated with the hand for which conventional mittens and gloves are uncomfortable or difficult to put on. For the very young, a hand garment that is not readily pulled off by the child, while at the same time easy and comfortable to put on, and that allows the wearer to grasp a bottle, or a ball, or play in the snow, for example, is desirable. For others, particularly those with disorders that affect hand use or mobility, such as Dupytron's contracture, which bends the fingers into a curl, or Rett Syndrome, in which stereotypic hand movements and loss of purposeful hand use prevent the wearer from cooperating with dressing, it is desirable to have a hand garment that is warm, lightweight, easy to put on, and shaped to comfortably fit the distended or disfunctional hand.

SUMMARY OF THE INVENTION

It is one of the objects of the present invention to provide a fingerless hand garment having a unique fan shape to allow for convenient hand use during outdoor play or other activity requiring normal hand use.

It is another object of the present invention to provide a hand garment that is shaped to comfortably fit any hand, including a severely disfunctional hand, to allow maximum mobility of the fingers.

It is yet another object of the present invention to provide a fingerless hand garment having a fan shape using a fabric that is comfortably soft, lightweight, breathable, quick drying, hydrophobic, machine washable, non-raveling and stretchable.

It is yet another object of the invention to have a hand garment with a seamless transition between the hand portion and the wrist portion, and where the wrist portion, or cuff, is made of the same material as the rest of the garment.

It is yet another object of the invention to have a hand garment where the cuff tapers from the opening toward the wrist and the opening has a fringed edge for ease of insertion of the hand.

According to the present invention, a fingerless garment for the hand is described in which an insulating fabric is arranged to define a unitary fan-shaped chamber of generally circular configuration and a diameter to accommodate therein the hand of the wearer when the fingers are disposed in a widely divergent and coplanar relationship and an elongated cuff of the same fabric through which the hand can be conveniently inserted and which forms a close fit around the wrist to prevent the garment from slipping off.

DETAILED DESCRIPTION OF THE PREFERRED EMBODIMENT

Relatively new, man-made, knit construction fabrics of the type generally described as Polarfleece® have made possible the development of comfortable hand garments that are warm, economical, and easy to put on the hands of an infant or toddler, or person of any age for whom dressing is difficult. These fabrics are stretchable, and as implemented in the present invention, form-fitting around the wrist to prevent the garments from slipping off during active use.

Lightweight versions of Polarfleece® fabrics are soft, quick drying and wick moisture away from the body. Medium weight versions offer additional warmth and improved durability. Heavy weights may include lamination techniques of several layers that combine water resistance, wind resistance and non-piling technology. To make Polarfleece® fabrics waterproof a shell out of a waterproof material, such as Gore-tex® can be added.

Figure 1:
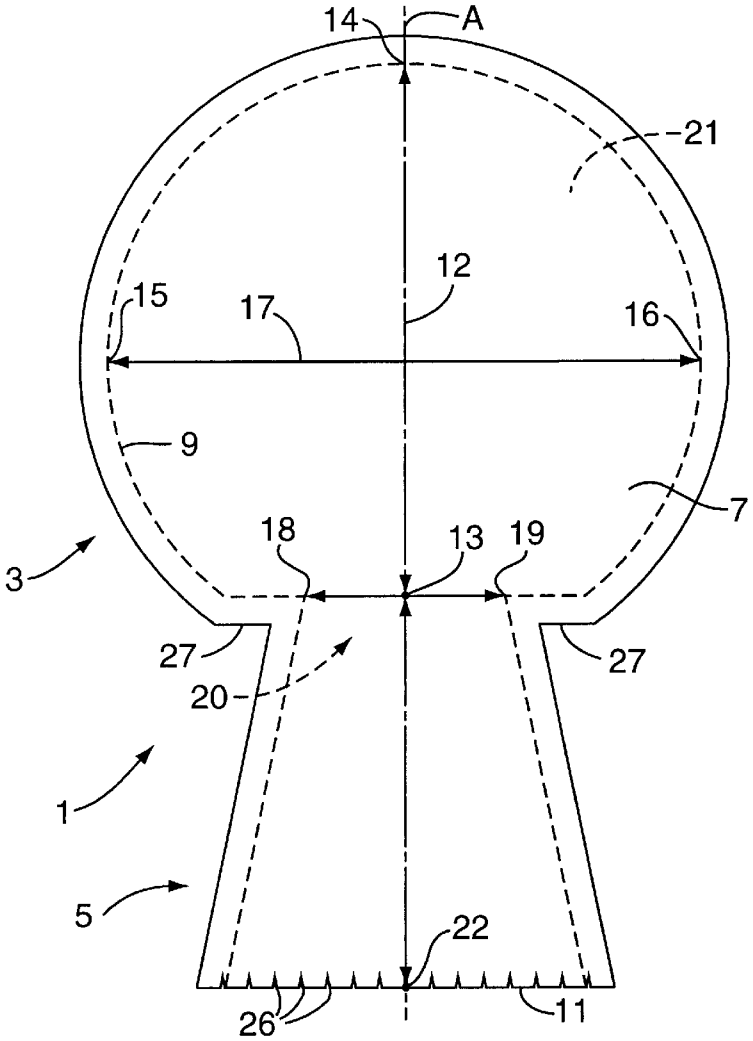
FIG. 1 depicts a schematic view of a child sized hand garment of the present invention.

Referring to FIG. 1, in a hand garment of the present invention, two pieces of Polarfleece® type fabric 7, each shaped approximately as shown, are sewn together at seam 9. The hand garment 1 has a hand portion 3 defining a generally spherical chamber 21 and an elongated cuff portion 5 having an opening 11 for insertion of the hand. The cuff portion 5 extends a distance equal to a substantial portion of the widest dimension of the hand portion 3. The seam 9 is approximately ½ to ⅝ inches in width. The hand garment is symmetrical about axis A—A.

In the preferred embodiment, the dimension from the wrist 13 to the furthest point 14 is approximately 1.4 to 1.5 times the dimension from the side 15 to opposing side 16. The dimensions must be such that the hand may be fully extended within the hand garment, providing ample room so that utilization of the hand for grasping objects is not restricted by the shape of the garment. The actual dimensions of the hand garment vary with the size of the garment, but typically, for a child between the ages of four and six, dimensions 13 and 17 are approximately 8.5 inches and 6 inches, respectively, as shown in FIG. 1.

To prevent the garment from inadvertently slipping off, an elongated cuff 5 is provided. The length of the cuff 5 from point 13 to point 21 is at least 70% the length of the hand portion 3 from point 14 to point 13. For a child between the ages of four and six, the cuff 5 is approximately 4.5 inches in length from the wrist 13 to the edge of the garment 21 at the opening 11. Shoulders 27, as shown at the junction of the hand portion 3 and the cuff portion 5, also help to prevent the hand garment from slipping off during use. The opening 20 into the hand chamber, viewed orthogonally to FIG. 1, is generally circular and of a dimension to provide a close-fit around the wrist.

Figure 2:
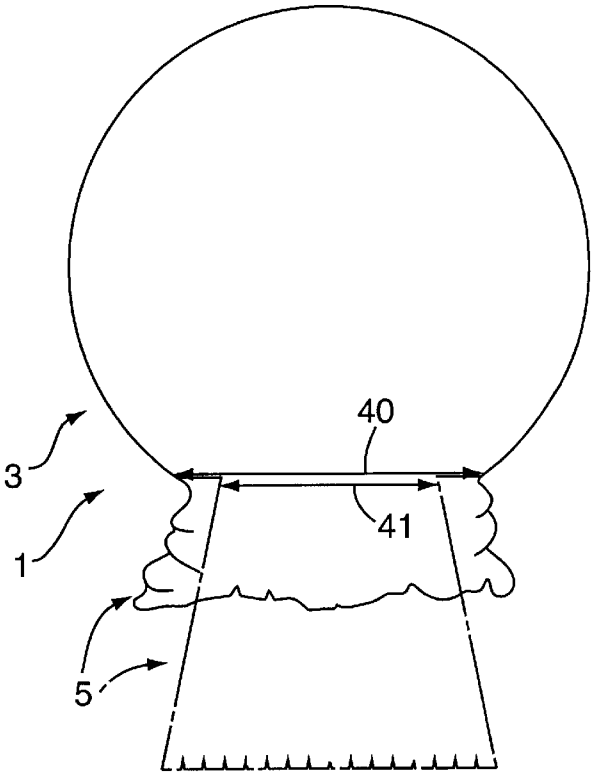
FIG. 2 depicts the hand garment of FIG. 1 with the elongated cuff in a stretched position for insertion of the hand.

Referring to FIG. 2, use of the inherently stretchable Polarfleece® fabric allows a close-fit at the wrist without the need for elastic or Velcro®, thus providing for comfort and economical manufacture. When the elongated cuff 39 is stretched, the dimension 40 is approximately 75% greater than the corresponding dimension 41 of the cuff in the unstretched position, permitting easy insertion of the hand, an object of the present invention that is particularly important for the very young or the person whose fingers lack dexterity or is unable to cooperate in dressing.

Referring again to FIG. 1, in the preferred embodiment, the elongated cuff 5 of the present invention is narrower at the point 20 where it meets the hand portion 3 than at the opening 11, in order to help prevent the garment from slipping off. The tapered shape also provides for ease of insertion of the hand. In the preferred embodiment, the width of the cuff is tapered such that the width at the opening 11 is at least one inch greater than the corresponding width at the wrist. For a child between the ages of four and six, the width of the fabric at the wrist from one side 18 to the opposite side 19 is approximately 2 inches.

In the preferred embodiment, the opening 11 has a plurality of slits 26 approximately ¼ inch in length to facilitate hand insertion. The non-raveling fleece fabric of the type typically described as Polarfleece®, permits the slits 26 to be cut directly into the fabric without the need for stitching or hemming to prevent unraveling.

Figure 4:
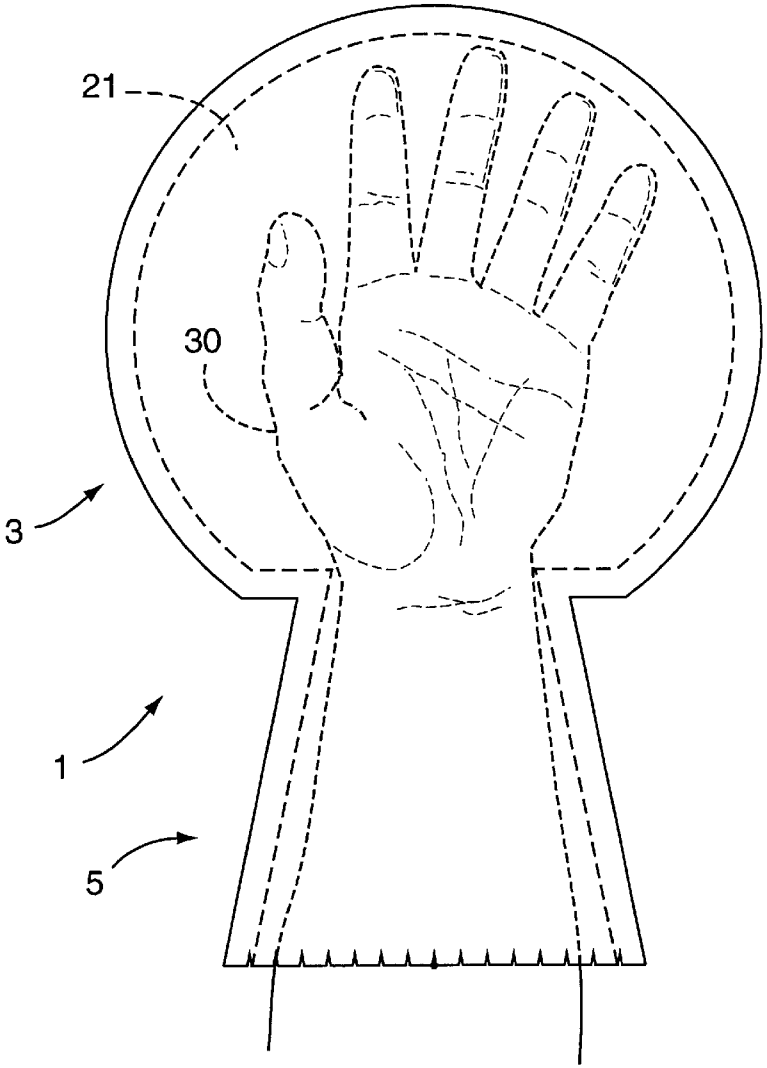
FIG. 4 depicts the hand garment of FIG. 3 on the right hand of a child.
Figure 3:
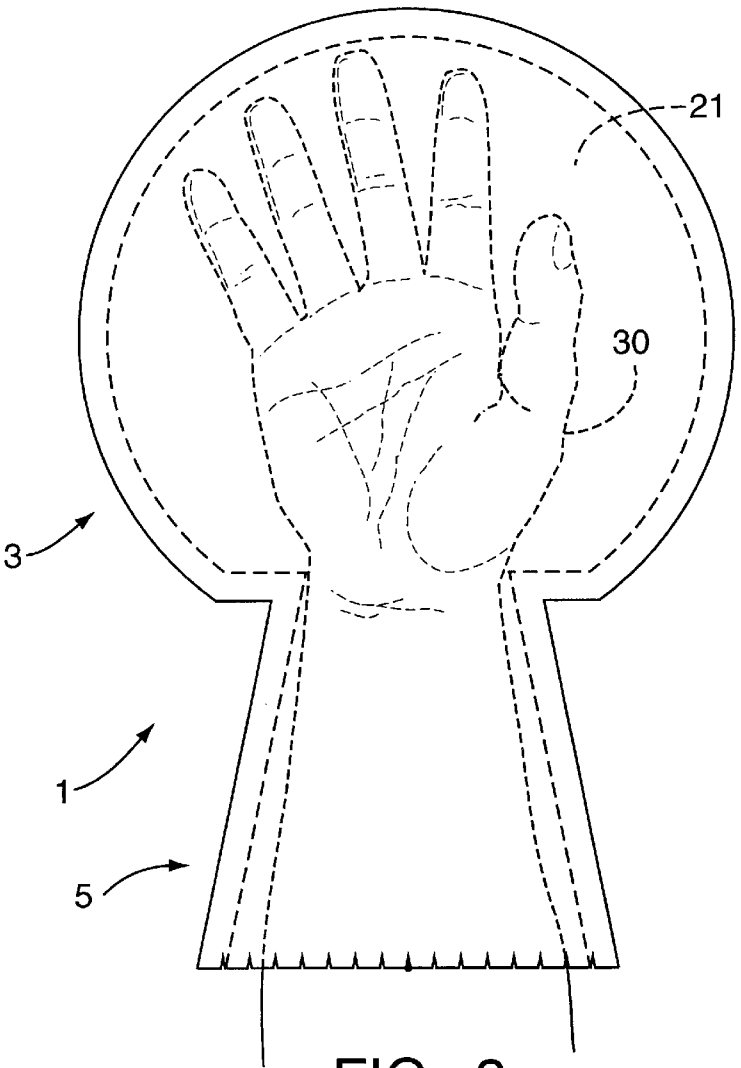
FIG. 3 depicts a child sized hand garment of the present invention shown on the left hand.

Referring now to FIGS. 3 and 4, the hand 30 of a typical two year old is shown in the fingerless hand garment 32 of the present invention. As depicted, there is ample material to permit full extension of the fingers within the garment, enabling the wearer to conveniently grasp objects. The symmetric design of the hand garments of the present invention permit ambidextrous use.

In another embodiment of the present invention, extremely lightweight fabrics can be used for neonatal applications, for example, to prevent newborns from scratching or pulling off eye shades while receiving treatment for jaundice. The hand garment of the present invention can also be used by people who are institutionalized in a profoundly disabled state unable to cooperate in dressing and who may have poor circulation in the extremities. Other medical applications will occur to those skilled in the art.

While the present invention has been illustrated and described with respect to a particular embodiment thereof, it should be appreciated by those of ordinary skill in the art that various modification to this invention may be made without departing from the spirit and scope of the invention.

I claim:

1. A fingerless garment comprising an insulating fabric arranged to define a unitary fan shaped chamber of generally circular configuration and a diameter to accommodate therein the hands of the wearer when the fingers are disposed in a widely divergent and coplanar relationship, an opening to provide sole access for said hands into and out of said chamber and an elongated cuff of said fabric that extends from an upper end thereof which is disposed about said opening a predetermined distance below said upper end of said cuff the distance approximately equal to a substantial portion of the diameter of said chamber.

2. A fingerless garment as set forth in claim 1, in which said garments are fabricated of a knit construction fleece type fabric.

3. A fingerless garment as set forth in claim 2, and in which said cuff is flared outwardly from the upper to the lower end thereof, the length of said sleeve and the extent of its flare serves as a reminder of the tight fit and special care in orienting the hand in the best predisposition to fit into and through the opening.

4. A fingerless garment comprising:

a knit construction fleece type fabric arranged to define a unitary fan-shaped chamber of generally circular configuration and a diameter to accommodate therein the hands of the wearer when the fingers are disposed in a widely divergent and coplanar relationship;

an opening to provide sole access for said hands into and out of said chamber; and an elongated cuff of said fabric that extends from an upper end thereof, which is disposed about said opening, a predetermined distance below said upper end of said cuff a distance approximately equal to a substantial portion of the diameter of said chamber, wherein said cuff is flared outwardly from the upper to the lower end thereof and has a plurality of slits at the lower end thereof to facilitate insertion of the hand.

5. A fingerless garment comprising:

a knit construction fleece type fabric arranged to define a unitary fan-shaped chamber of generally circular configuration and a diameter to accommodate therein the hands of the wearer when the fingers are disposed in a widely divergent and coplanar relationship;

an opening to provide sole access for said hands into and out of said chamber; and an elongated cuff of said fabric that extends from an upper end thereof, which is disposed about said opening, a predetermined distance below said upper end of said cuff a distance approximately equal to a substantial portion of the diameter of said chamber, in which the dimension from said upper end to said lower end of said cuff is at least 70% of the largest dimension between any two points on the periphery of said unitary fan shaped chamber.

6. A fingerless garment as set forth in claim 1, having a plurality of layers of said insulating fabric.

7. A fingerless garment as set forth in claim 1, in which the outer layer is a water-resistant material.

* * * * *